US008376048B2

(12) United States Patent
Cochran

(10) Patent No.: US 8,376,048 B2
(45) Date of Patent: Feb. 19, 2013

(54) OFFSHORE INSTALLATION ATTACHMENT SYSTEM

(75) Inventor: Jamie Cochran, Inverurie (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 581 days.

(21) Appl. No.: 12/349,950

(22) Filed: Jan. 7, 2009

(65) Prior Publication Data

US 2009/0173502 A1 Jul. 9, 2009

Related U.S. Application Data

(60) Provisional application No. 61/019,729, filed on Jan. 8, 2008.

(51) Int. Cl.
*E21B 23/00* (2006.01)

(52) U.S. Cl. ..... 166/338; 166/352; 166/381; 166/85.1; 285/261

(58) Field of Classification Search ..... 166/335, 166/339, 341, 344, 346, 351, 352, 381, 85.1, 166/241.3; 285/51, 81, 83, 261, 262; 294/86.1; 403/122, 123
See application file for complete search history.

(56) References Cited

U.S. PATENT DOCUMENTS

| | | | | | |
|---|---|---|---|---|---|
| 3,161,930 | A * | 12/1964 | Crosson | 403/3 |
| 3,433,510 | A * | 3/1969 | Hulterstrum | 403/77 |
| 3,445,133 | A * | 5/1969 | Reischl | 294/82.1 |
| 4,173,367 | A * | 11/1979 | Haeussler | 294/82.34 |
| 4,206,782 | A * | 6/1980 | Tuson | 137/615 |
| 4,360,230 | A * | 11/1982 | Wood et al. | 294/90 |
| 4,508,296 | A * | 4/1985 | Clark | 244/173.1 |
| 4,671,554 | A * | 6/1987 | Lancelot | 294/89 |
| 5,074,699 | A * | 12/1991 | Blaisdell et al. | 403/122 |
| 5,624,147 | A * | 4/1997 | Arteon et al. | 294/89 |
| 6,142,546 | A * | 11/2000 | Hansort | 294/89 |
| 6,152,509 | A * | 11/2000 | Hansort | 294/89 |
| 6,345,672 | B1 * | 2/2002 | Dietzen | 175/66 |
| 6,767,155 | B2 * | 7/2004 | O'Brien et al. | 403/322.1 |
| 6,923,592 | B2 * | 8/2005 | Crandall | 403/127 |
| 7,562,919 | B2 * | 7/2009 | Lawley | 294/1.1 |
| 7,762,735 | B2 * | 7/2010 | Clayton et al. | 403/76 |
| 2006/0201679 | A1 * | 9/2006 | Williams | 166/344 |

FOREIGN PATENT DOCUMENTS

| | | |
|---|---|---|
| GB | 2408251 A | 5/2005 |
| WO | 01/32501 A1 | 5/2001 |
| WO | 2005054048 A1 | 6/2005 |

* cited by examiner

*Primary Examiner* — Matthew Buck
(74) *Attorney, Agent, or Firm* — Myron K. Stout; Daryl Wright; Robin Nava

(57) ABSTRACT

A method of lifting at least a portion of an attachment system to and from a predetermined location comprises providing an attachment system comprising a support member, a socket member, and a locking member, the support member located at the predetermined location and defining an indentation formed therein, the socket member defining a cavity formed therein, placing the socket member in the indentation, placing the locking member in the cavity, locking the locking member in the socket member, and lifting the locked socket member and locking member from the support member and to the predetermined location.

20 Claims, 13 Drawing Sheets

OFFSHORE INSTALLATION ATTACHMENT SYSTEM

CROSS-REFERENCE TO RELATED APPLICATION

This application is entitled to the benefit of, and claims priority to, provisional patent application 61/019,729 filed Jan. 8, 2008, the entire disclosure of which is incorporated herein by reference.

BACKGROUND

The statements in this section merely provide background information related to the present disclosure and may not constitute prior art. The system and method relate in general to offshore oilfield equipment such as, but not limited to, offshore platforms and oilfield support vessels, such as well stimulation vessels and equipment.

When lifting a high pressure treating hose from a vessel to a platform, a manual connection and disconnection of the crane hook from a lifting eye may be required. This may be a difficult task to perform when on the aft deck of a well stimulation vessel, where the treating hose reels are conventionally located. It is difficult primarily because the vessel motion is often exaggerated and worst at the aft end of the vessel, therefore vertical movement is large, especially in relation to the non-moving or slow-moving crane hook. This activity may expose personnel on the vessel to hazards such as falling overboard, being struck by the crane hook, or muscle strains when manipulating the lifting equipment.

It is always desirable to improve the operation of offshore oilfield equipment and the like.

SUMMARY

An embodiment of a method of lifting at least a portion of an attachment system to and from a predetermined location comprises providing an attachment system comprising a support member, a socket member, and a locking member, the support member located at the predetermined location and defining an indentation formed therein, the socket member defining a cavity formed therein, placing the socket member in the indentation, placing the locking member in the cavity, locking the locking member in the socket member, and lifting the locked socket member and locking member from the support member and to the predetermined location. Alternatively, locking comprises rotating the socket member within the support member to lock the locking member in the socket member. Alternatively, the method further comprises returning the locked socket member and locking member to the support member, rotating the socket member to unlock the locking member from the socket member, and removing the locking member from the socket member.

Alternatively, the method further comprises providing at least one guide member to guide the locking member into the cavity, the at least one guide member attached to and extending upwardly from the support member. Alternatively, the predetermined location is a vessel deck and wherein the support member is attached to the vessel deck. Alternatively, the socket member further comprises a lever arm to lock the locking member into the socket member indentation. Alternatively, locking comprises remotely locking the locking member in the socket member.

Alternatively, the locking member further comprises an internal mechanism in the locking member comprising a spring loaded double rack and pinion with a central pinion gear operable to prevent the locking member from detaching from the socket member. Alternatively, the locking member is attached to a lanyard and wherein lifting comprises raising and lowering the locking member by a crane. Alternatively, the method further comprises attaching a hose to the socket member and connecting the hose to a source of wellbore treatment fluid and performing a well services operation. Alternatively, the method further comprising paying out a predetermined length of the hose prior to lifting.

In an embodiment, an attachment system for lifting a hose to and from a predetermined location comprises a support member defining an indentation formed therein, a socket member adapted to attach to a hose and to releasably rest in the indentation, the socket member defining a cavity formed therein, the sling socket rotatable with respect to the support member, a locking member attached to a lanyard, and a lifting device for raising and lower the locking member and lanyard with respect to the support member, wherein when the lifting device lowers the locking member into the indentation, and the socket member is rotated to lock the locking member in the socket member, the lifting device is operable to lift the locked socket member and locking member from and return the locked socket member and locking member to the support member.

Alternatively, the lever arm is remotely actuated. Alternatively, the locking member further comprises an internal locking device to lock the locking member in the socket member. The locking device may comprise a spring loaded double rack and pinion with a central pinion gear operable to prevent the locking member from detaching from the socket member.

In an embodiment, a method of lifting a hose to and from an offshore oil platform from an oceangoing stimulation vessel comprises providing a remotely actuated attachment system comprising a support member, a socket member, and a locking member, the support member located on the vessel and defining an indentation formed therein, the socket member defining a cavity formed therein and attached to the hose, the locking member attached to a lanyard extending from a crane on the platform, placing the socket member in the indentation and attaching a hose to the socket member, placing the locking member in the cavity, locking the locking member in socket member, and lifting the locked ball, sling socket, and hose from the support member with the crane.

Alternatively, locking comprises rotating the socket member within the support member to lock the locking member in the socket member. Alternatively, the method further comprises returning the locked socket member and locking member to the support member, rotating the socket member to unlock the locking member from the socket member, and removing the locking member and lanyard from the socket member. Alternatively, the method further comprises connecting the hose to the platform and to a source of wellbore treatment fluid and performing a well services operation.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
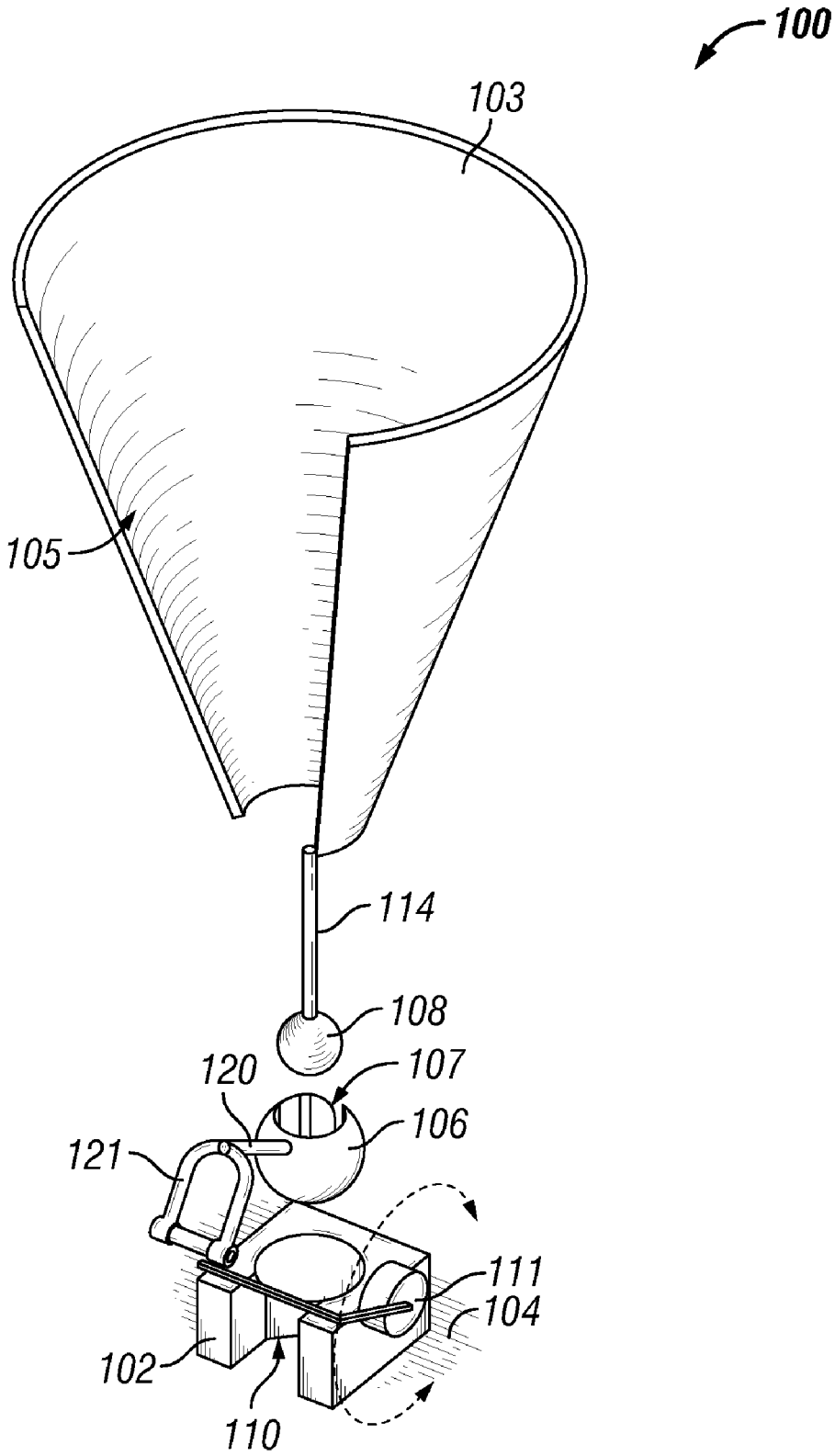
FIG. 1 is a schematic exploded perspective view of an embodiment of an attachment system.
Figure 2:
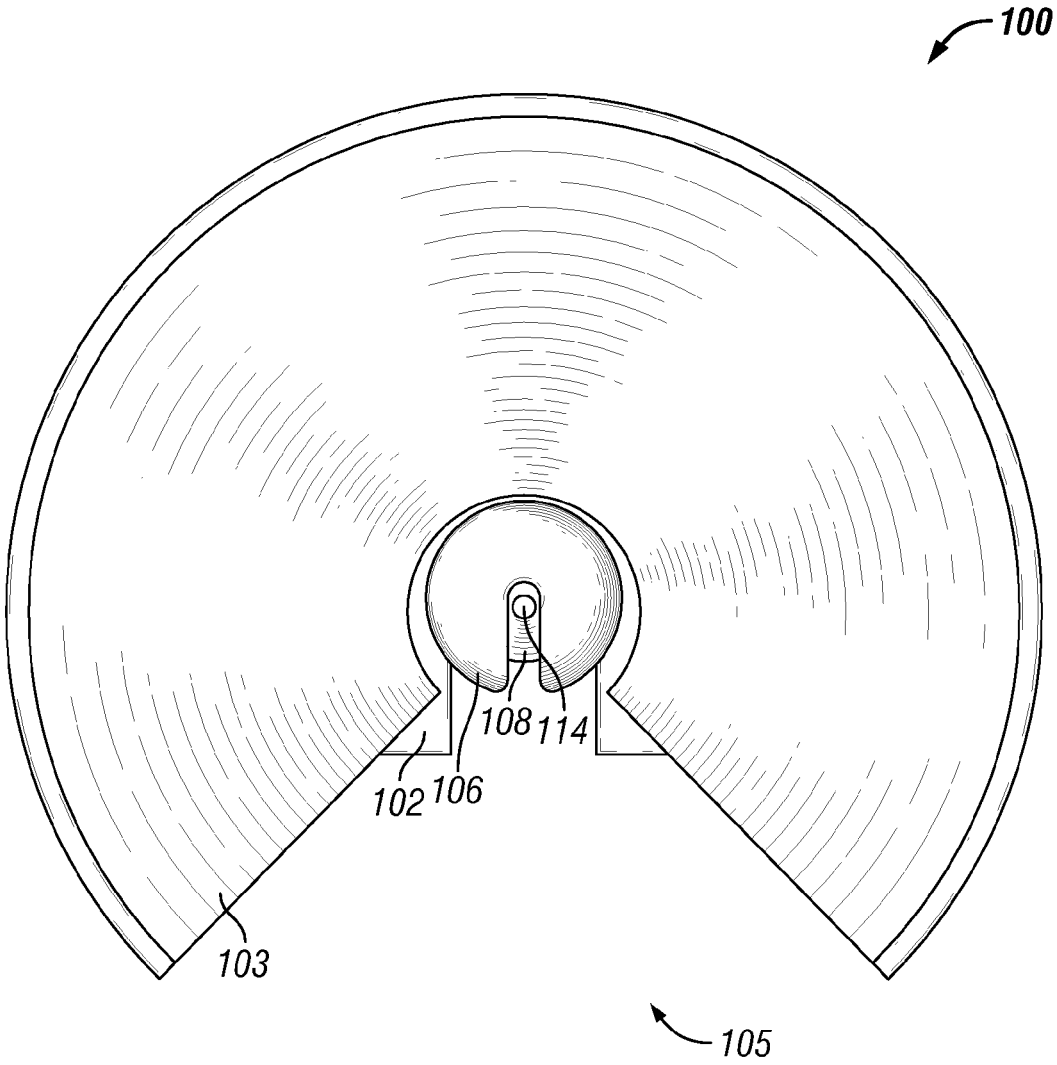
FIG. 2 is a plan view of the system of FIG. 1 shown assembled.
Figure 3:
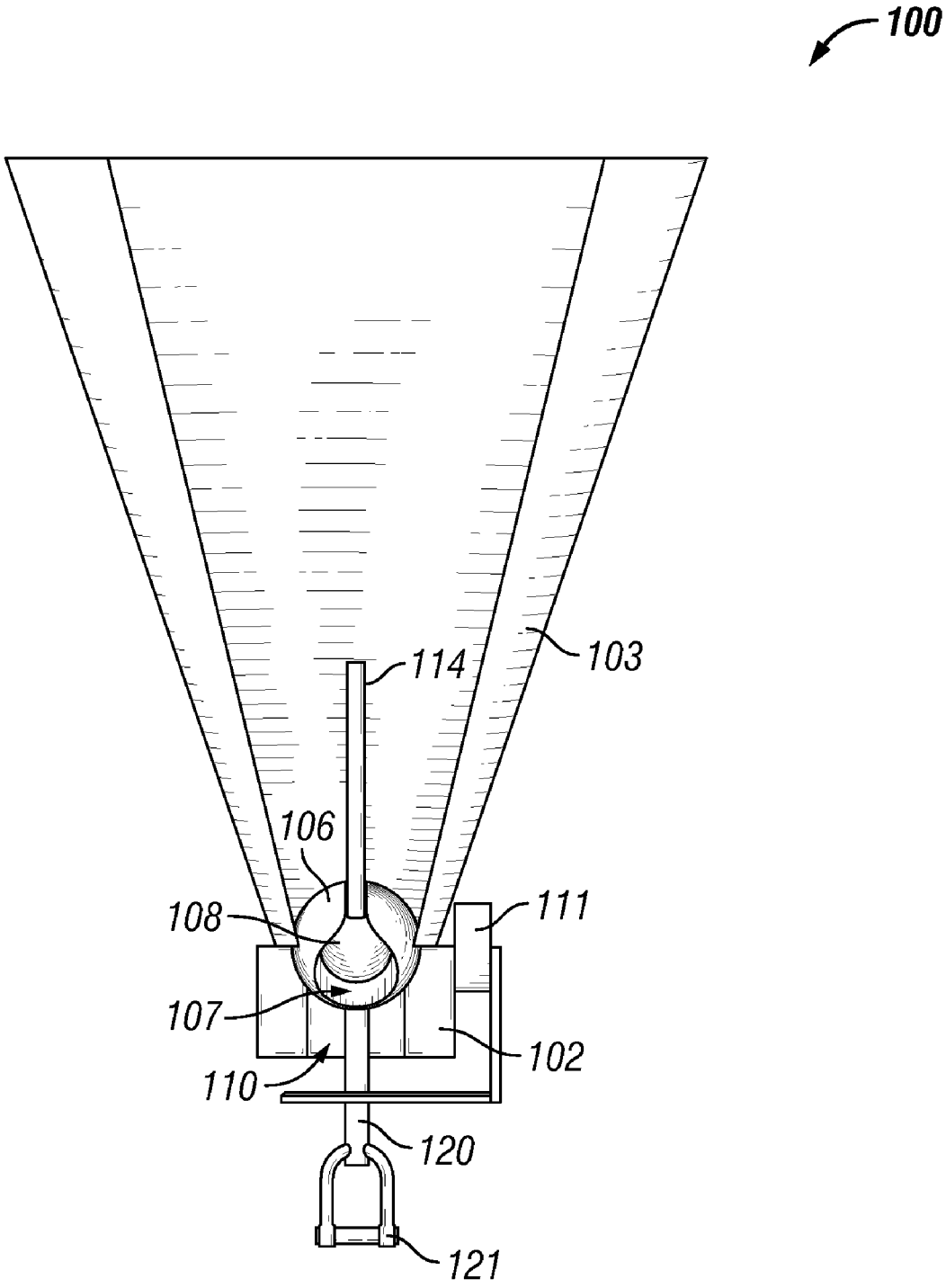
FIG. 3 is an end view of the system of FIG. 2.

Referring now all of the Figures, an embodiment of an attachment system is indicated generally at 100. The system 100 comprises a preferably stationary support member 102 disposed on an attachment surface or base 104. The base 104 is a predetermined location, such as a ship deck or the like. The system 100 also comprises a socket member 106 and a locking member 108. The support member 102 defines an indentation 110 on an inner portion thereof. The support member may comprise at least one guide member 103 extending upwardly therefrom and defining a channel 105 therebetween. The indentation 110 is preferably sized to receive the socket member 106 therein during operation of the system 100, discussed in more detail below.

Figure 4A:
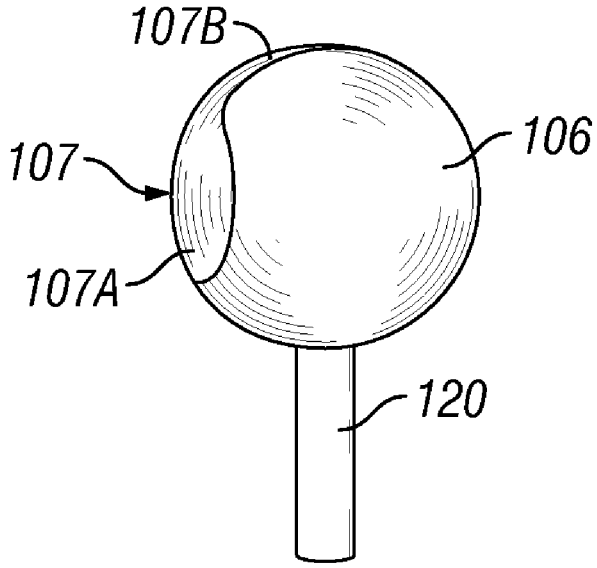
FIGS. 4*a* and 4*b* are schematic perspective views of the socket member of FIG. 1.
Figure 4B:
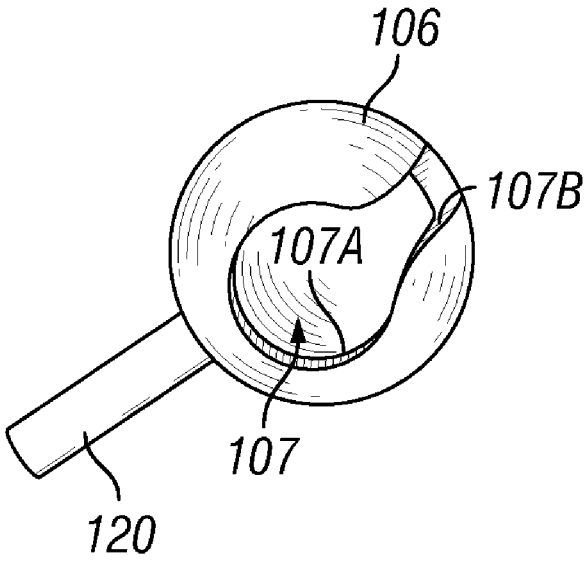
Figure 6:
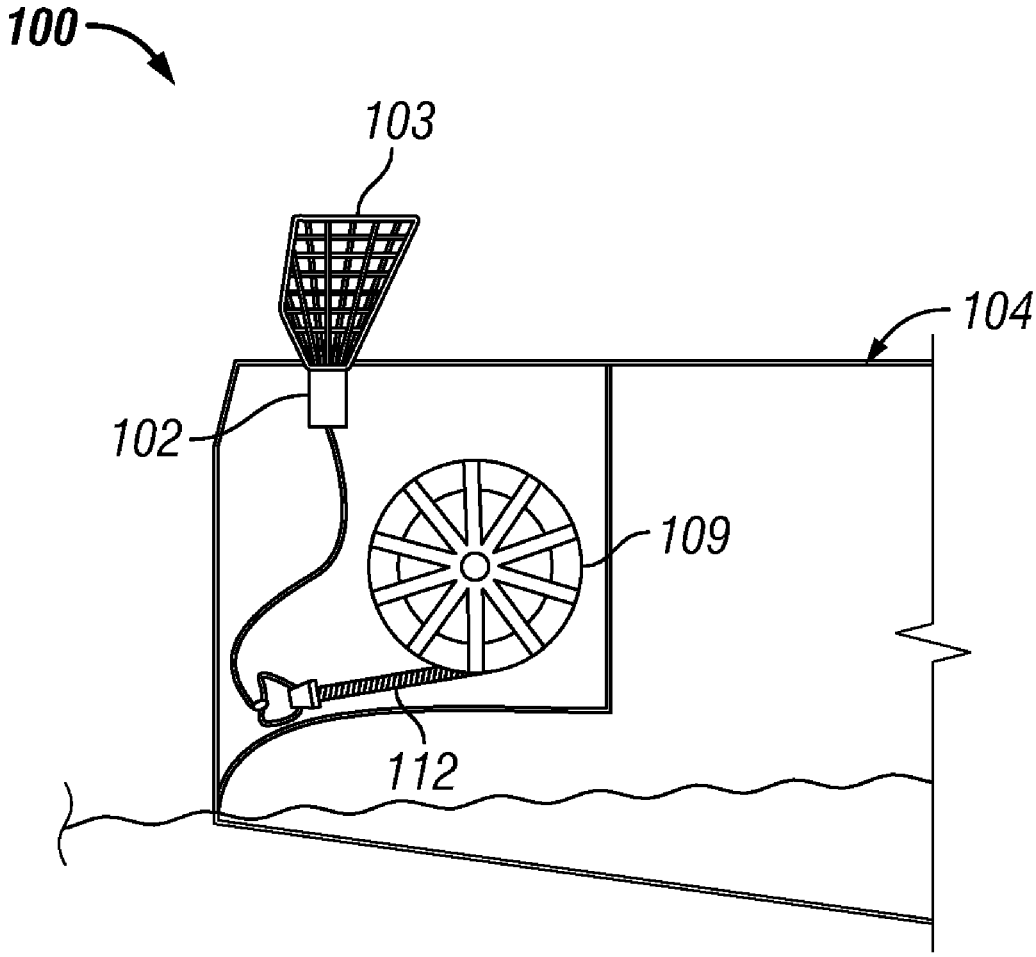
FIG. 6 is a schematic view of an embodiment of an attachment system and hose reel.
Figure 15:
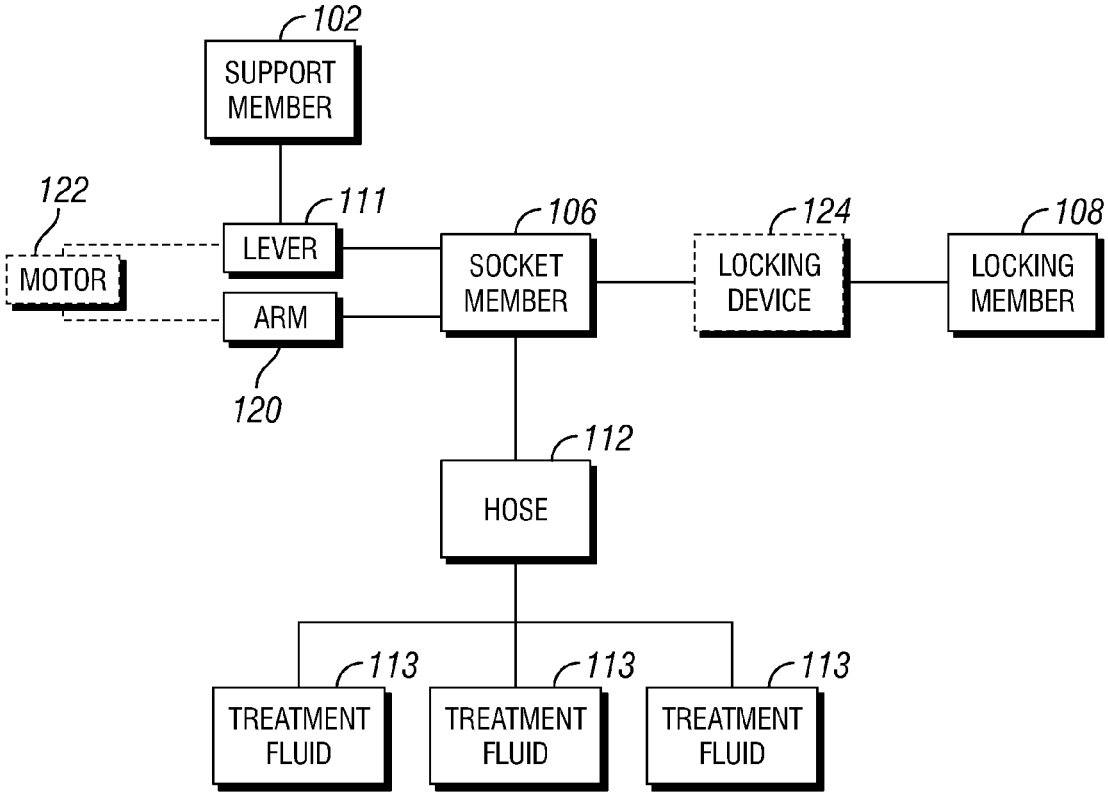
FIG. 15 a block diagram of an embodiment of an attachment system.

The socket member 106 is preferably attached to a hose 112 or similar apparatus, best seen in FIG. 6, such as by a shackle 121 or similar attachment device. The hose 112 may be spooled on a reel 109, as will be appreciated by those skilled in the art. The hose 112 may be attached to at least one treatment fluid source 113 (best seen in FIG. 15) for a wellbore operation such as, but not limited to, fracturing fluid, acidizing fluids or wellbore and matrix treatment fluids or the like for transferring the treatment fluid from the vessel 104 to an offshore platform 118 or the like. The socket member 106 may include a lever arm or actuating arm 120 extending therefrom. The socket member 106 defines a cavity 107 formed therein that is preferably sized to receive the locking member 108 therein during operation of the system 100, discussed in more detail below. The cavity 107 may comprise a substantially circular portion 107*a* and a channel 107*b*, best seen in FIGS. 4*a* and 4*b*.

Figure 5:
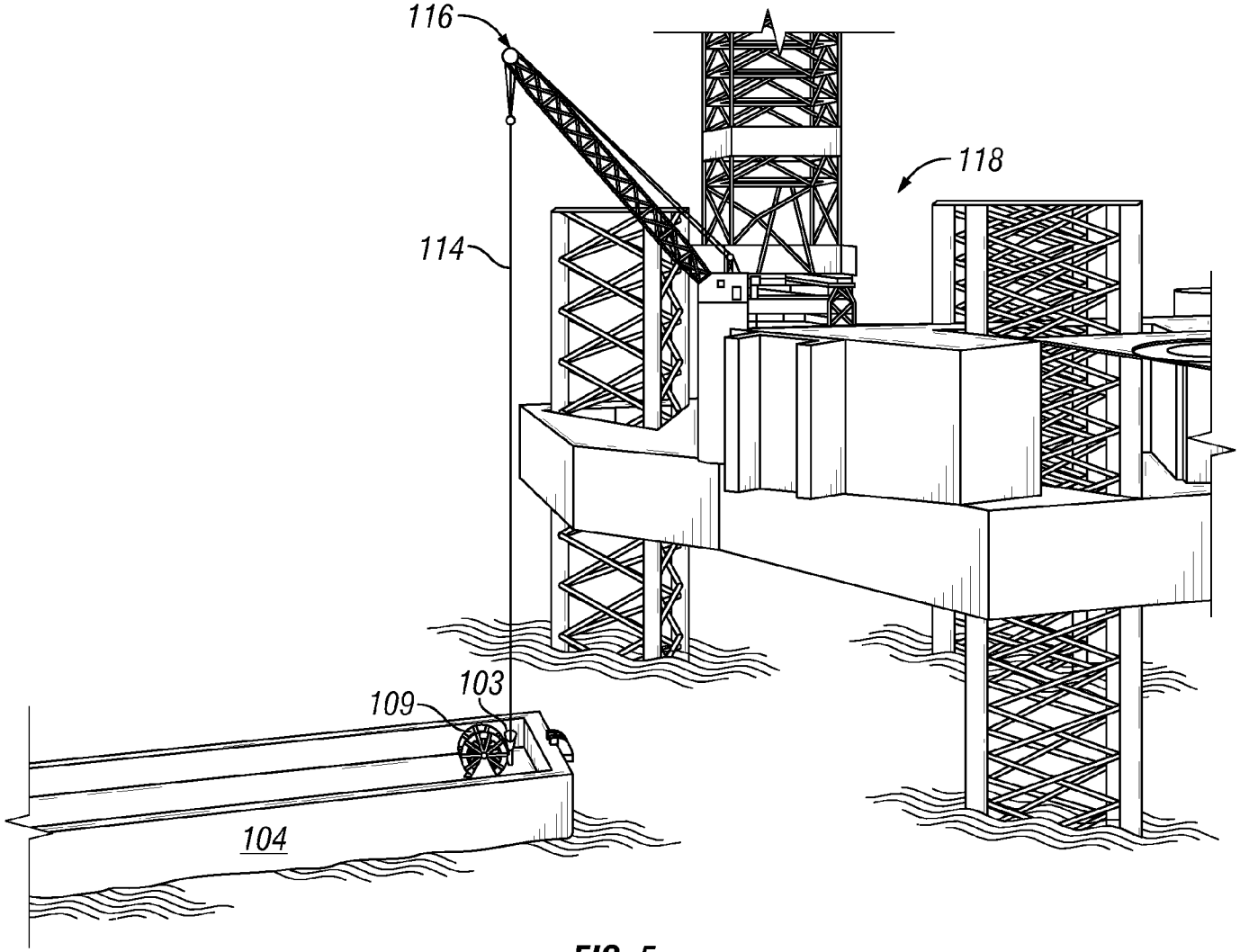
FIG. 5 is a schematic view of an embodiment of an attachment system adjacent an offshore platform.

The locking member 108 may be attached to a lanyard or cable 114 or similar device or apparatus such as, but not limited to, an arm or connector (not shown). The lanyard 114 may be attached to a crane 116 on, for example, an offshore platform 118 or the like, best seen in FIG. 5, as will be appreciated by those skilled in the art, to allow the locking member 108 to be raised and lowered from the offshore platform 118 to the base 104. The crane 116 may be any suitable lifting and lowering device, as will be appreciated by those skilled in the art.

In operation, the support member 102 of the system 100 is disposed on the vessel or base 104 and the socket member 106 is disposed in the indentation 110. The locking member 108 is lowered on the lanyard 114 in by the crane 116 to the base 104 and the guide members 103 allow the locking member 108 to be directed into the cavity 107 of the socket member 106. The guide member or members 103 may be angled outwardly to provide a wider channel 105 and provide a larger target for an operator to direct the locking member 108. The lowering and directing of the locking member 108 may advantageously be accomplished without requiring any personnel in the vicinity of the support member 102. When the locking member 108 lands in the guide member 103 and is further lowered down, the locking member seats in the cavity 107.

Once the locking member 108 is in place in the cavity 107, the socket member 106 is rotated within the indentation 110 (and rotated with respect to the support member 102) from a received position to a locked position to attach the socket member 106 to the locking member 108. The socket member 106 may be rotated a predetermined distance, such as 90 degrees or the like to move from the received position to the locked position. The lever arm or actuating arm 120 may be utilized to aid in the rotation of the socket member 106. The socket member 106 may be rotated by a lever 111 disposed adjacent the support member 102 that rotates the blue part to engage or disengage. A motor 122 or similar device may be utilized to remotely actuate and/or rotate the socket member 106 between the received position and the locked position and may be attached to the actuating arm 120 and/or the lever 111. The motor 122 may be controlled by a suitable control system for remotely actuating the motor 122, as will be appreciated by those skilled in the art.

Once the socket member 106 is in the locked position, an optional locking device 124 may be utilized to keep the socket member 106 locked to the locking member 108. The locking device 124 may be, but is not limited to, a spring-loaded detent and pawl mechanism or any suitable device operable to lock and unlock the socket member 106 and the locking member 108, as will be appreciated by those skilled in the art. The locking device 124 may be an internal mechanism in the locking member 108 for making a mechanical connection with the socket member 106.

Figure 7:
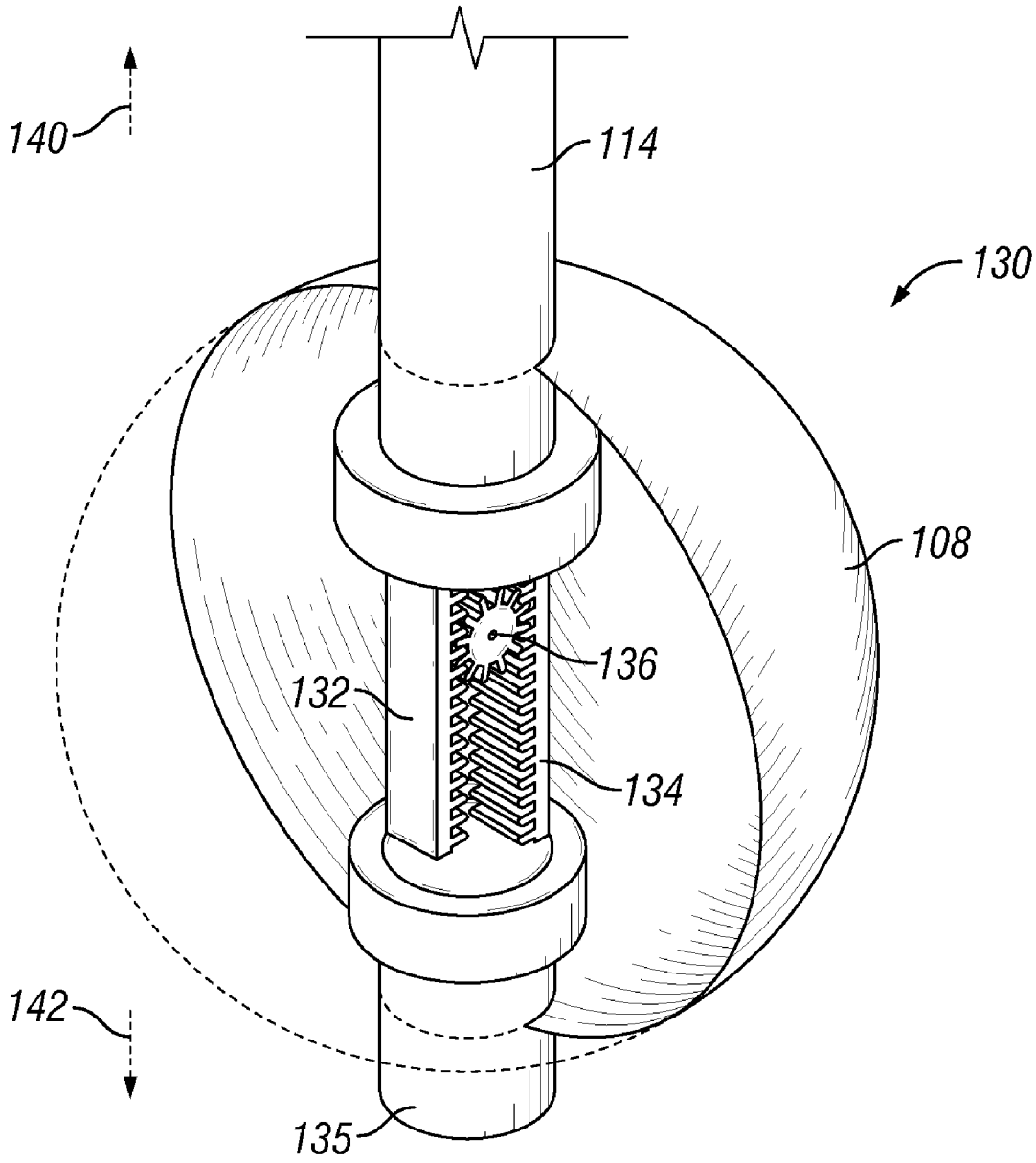
FIGS. 7-9 are schematic perspective views, respectively, of an embodiment of a locking device.
Figure 8:
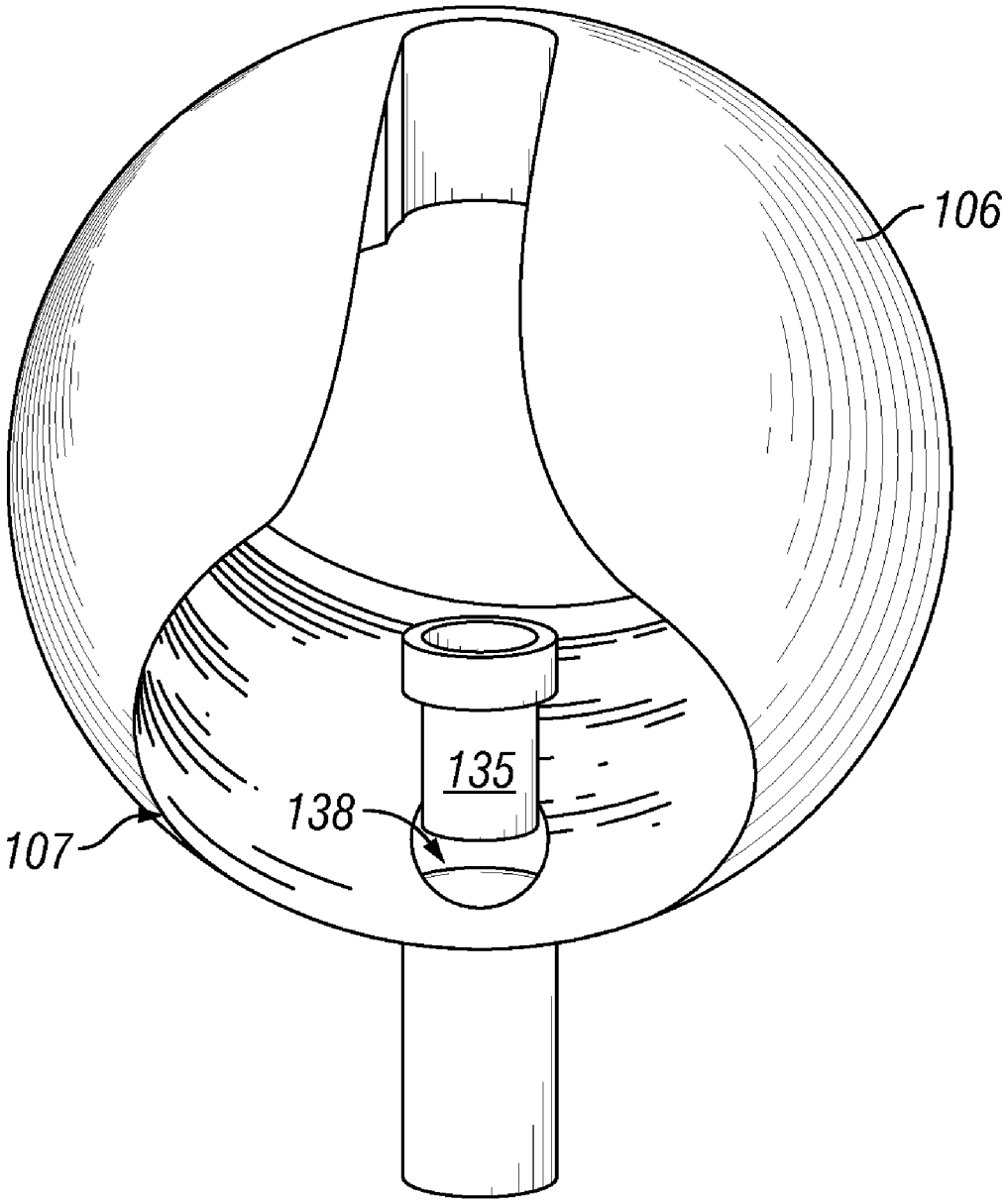
Figure 9:
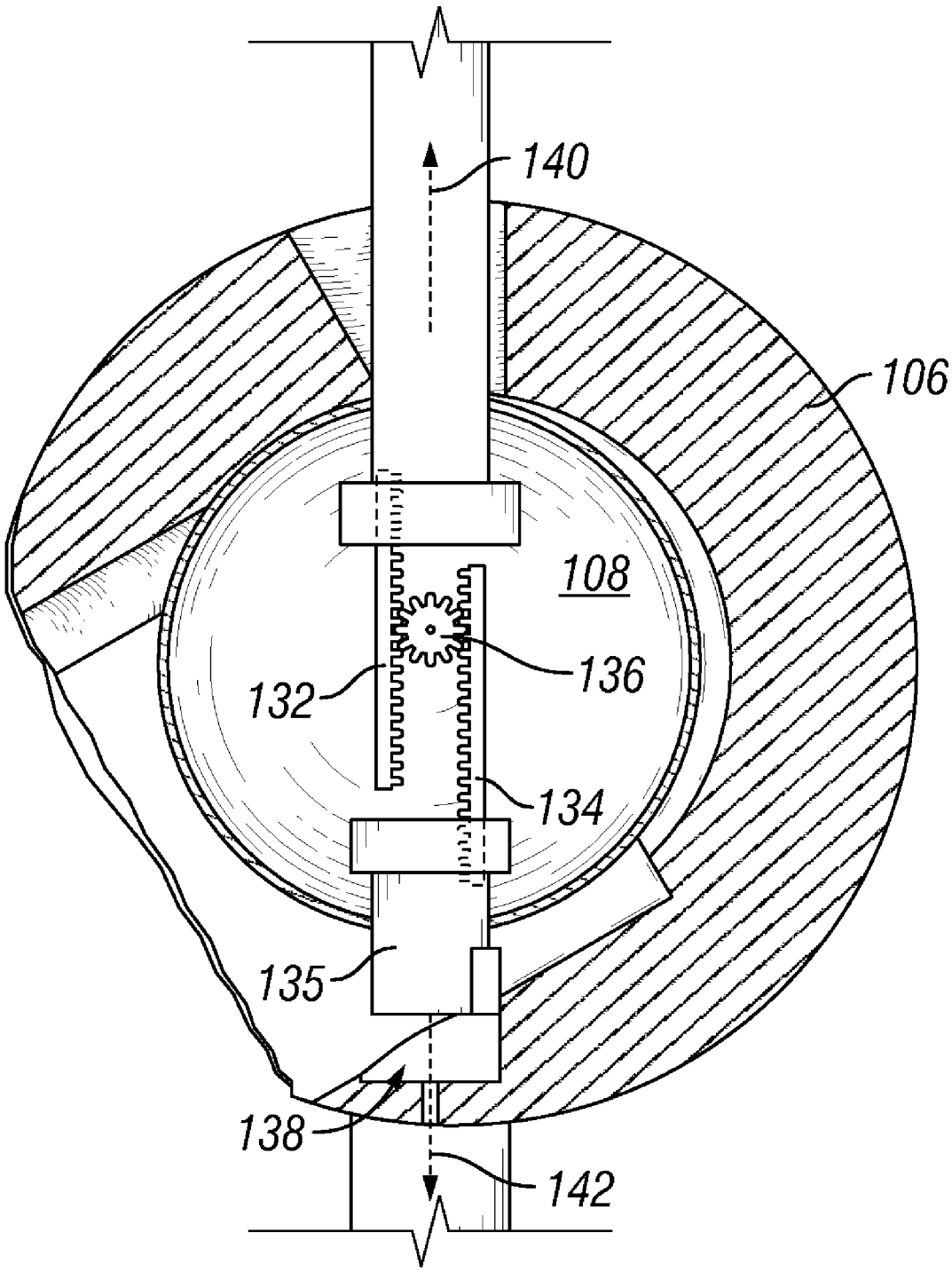
Figure 10:
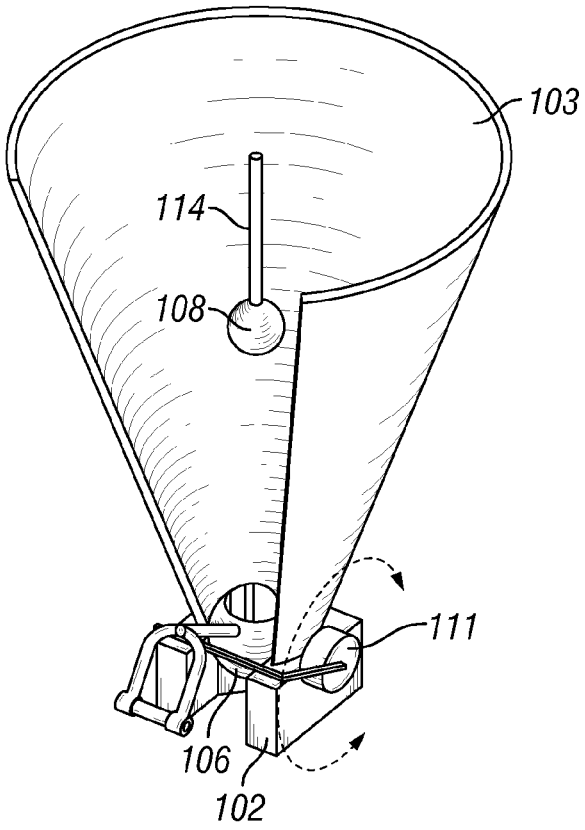
FIGS. 10-14 are schematic perspective views, respectively, the attachment system of FIG. 1 in use.
Figure 11:
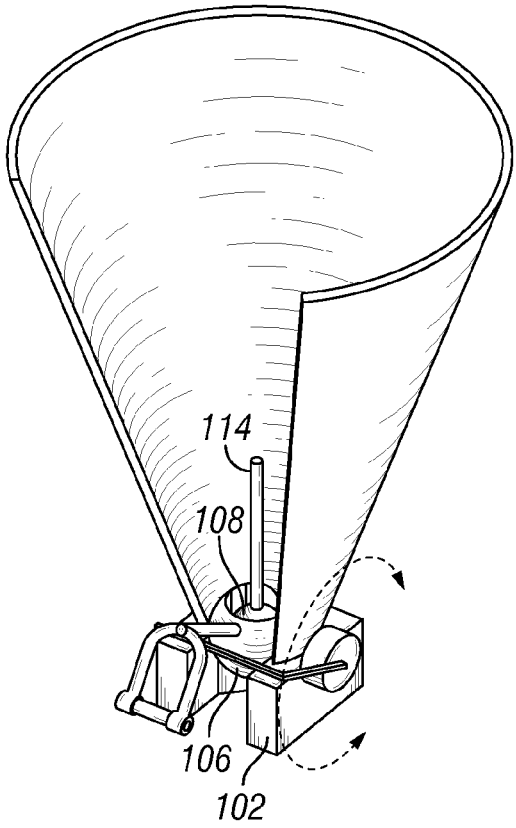
Figure 12:
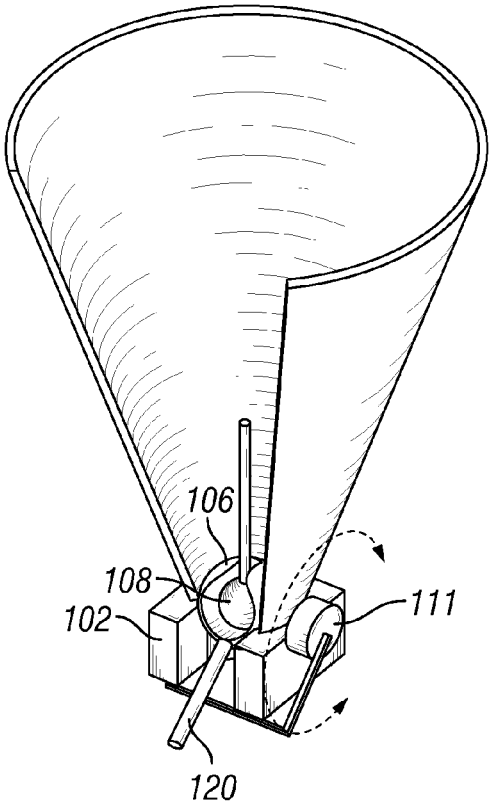
Figure 13:
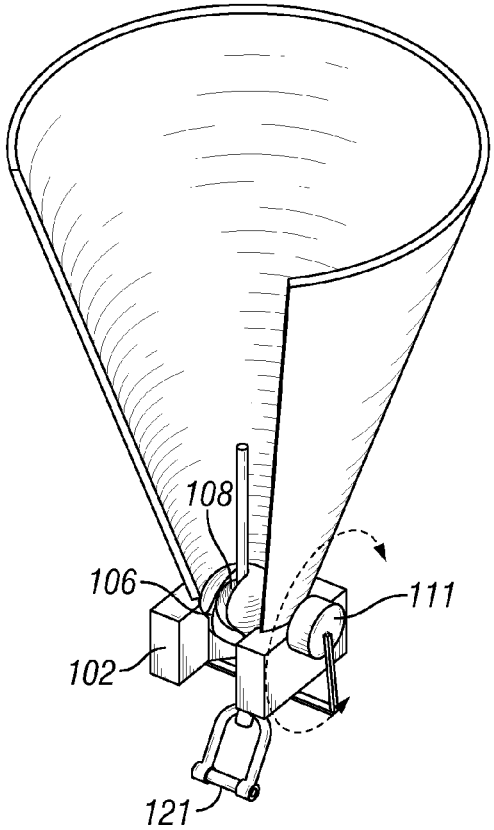
Figure 14:
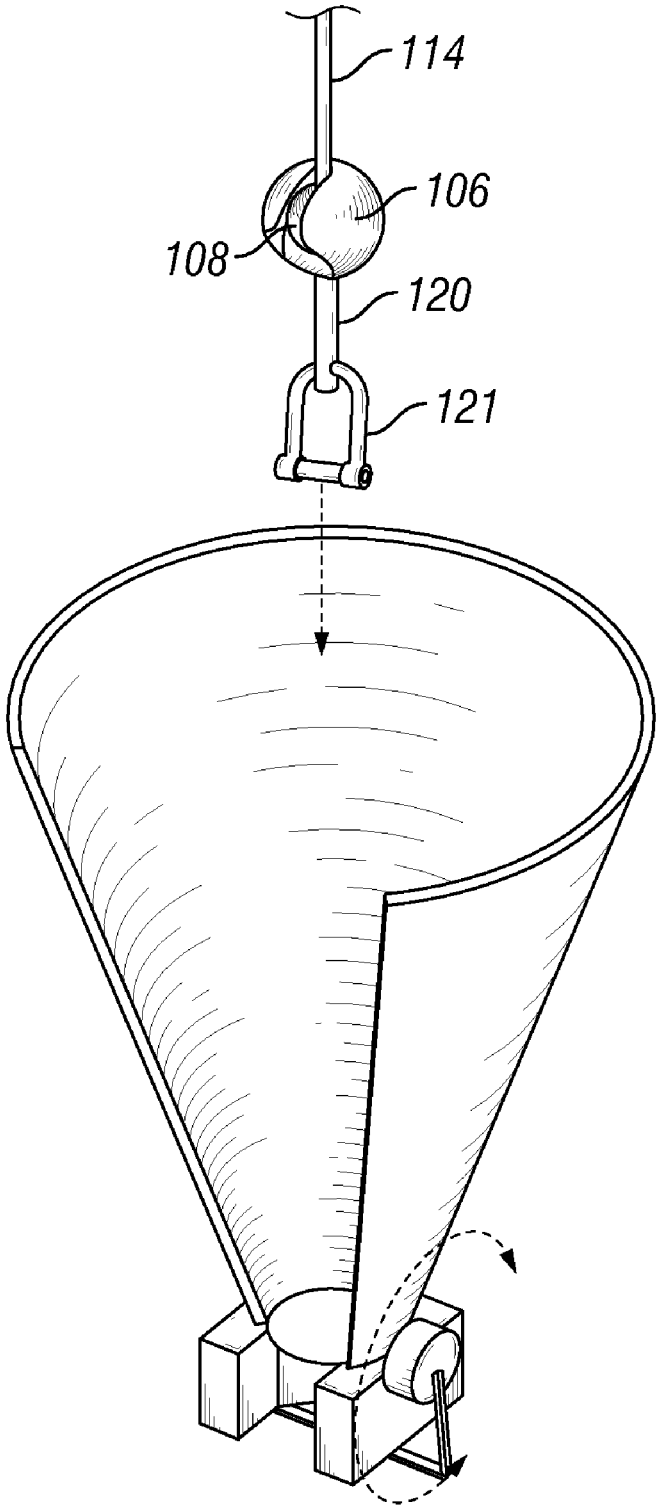

The locking device 124 may comprise a spring loaded double rack and pinion assembly 130 comprising a first rack 132 and a second rack 134 and a central pinion gear 136 disposed between the racks 132 and 134, best seen in FIGS. 7-9. A spring (not shown) biases the rack 134 in a direction indicated by an arrow 140 (upward as seen in FIG. 7-9). The lanyard 114 and connector (not shown) connected to the crane hook may be attached to the end of the rack 132 and a pin or extension 135 may be attached to the end of the rack 134. When weight is applied to the rack 132 (i.e. the lanyard 114 is pulled upwardly), the weight acts against the spring (not shown) to turn the pinion gear 136 in the locking member 108. The rotation of the pinion gear 136 moves the rack 132 in the direction 140 and, conversely, moves the other rack 134 in the opposite direction, as indicated by an arrow 142 (downwardly in FIGS. 7-9). The rack 134 and extension 135 then locates in a hole or detent 138 formed within the surrounding socket member 106, which advantageously acts as a safety lock to prevent the locking member 108 from falling out of the socket member 106 during subsequent movement because the weight applied to the lanyard 114 and connector (not shown) acts to keep the rack 134 and extension 135 extended into the hole 138. The hole 138 is preferably located within the cavity 107 adjacent the actuating arm 120, advantageously allowing the rack 134 to extend therein only when the socket member 106 is rotated to the locked position. The spring tension is preferably selected to allow the rack 134 and extension 135 to remain unextended when no weight is attached to the lanyard 114 and/or connector (not shown). Those skilled in the art will appreciate that any suitable device or mechanism 124 may be utilized to releasably prevent the rotation of the locking member 108 with respect to the socket member 106 such that the joined assembly may then be moved to a location remote from the support member 102. The device or mechanism 124 may be a spring-loaded or spring-biased detent and pawl mechanism or any device suitable for making a releasable mechanical connection between the socket member 106 and the locking member 108, as will be appreciated by those skilled in the art.

The joined assembly (the socket member 106 and the locking member 108) is then pulled or lifted out of the support member 102 and away from the aft of the vessel 104 to release the socket member 106 from the support member 102, such as through the channel 105 or the like.

The crane 116 can then pick up on the lanyard 114, the socket member 106 and the locking member 108 and lift the treating hose 112, which is spooled out while the lanyard 114 is lifted. The treating hose 112 is then attached to a connection on the platform 118 and may then be utilized to perform a well treatment operation including, but not limited to, a well stimulation operation, a matrix treatment, wellbore remediation treatment or a gravel pack treatment, and the like via suitable well treatment equipment (not shown) disposed on the vessel 104, as will be appreciated by those skilled in the art. Those skilled in the art will appreciate that multiple types of well treatments may be performed by the treatment vessel 104 and the treating hose 112 while remaining within the scope of the embodiments disclosed herein.

Advantageously, the treating hose 112 can be returned to the treatment vessel 104, with the joined assembly (the socket member 106 and the locking member 108) first landed in the guide member or members 103 and the base 102 and the steps noted above applied in a reverse order, as will be appreciated by those skilled in the art.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A method of lifting at least a portion of an attachment system to and from a predetermined location, comprising:

providing an attachment system comprising a support member disposed on a base, a socket member, and a locking member, the support member located at the predetermined location and defining an indentation formed therein, the socket member defining a cavity formed therein;

placing the socket member in the indentation;

placing the locking member in the cavity;

locking the locking member in the socket member; and lifting the locked socket member and locking member from the support member and from the predetermined location.

2. The method of claim 1 wherein locking comprises rotating the socket member within the support member to lock the locking member in the socket member.

3. The method of claim 1 further comprising returning the locked socket member and locking member to the support member, rotating the socket member to unlock the locking member from the socket member, and removing the locking member from the socket member.

4. The method of claim 1 further comprising providing at least one guide member to guide the locking member into the cavity, the at least one guide member attached to and extending upwardly from the support member.

5. The method of claim 1 wherein the predetermined location is a vessel deck and wherein the support member is attached to the vessel deck.

6. The method of claim 1 wherein the support member further comprises a lever to lock the locking member into the support member indentation.

7. The method of claim 1 wherein locking comprises remotely locking the locking member in the socket member.

8. The method of claim 1 wherein the locking member further comprises an internal mechanism in the locking member comprising a spring loaded double rack and pinion with a central pinion gear operable to prevent the locking member from detaching from the socket member.

9. The method of claim 1 wherein the locking member is attached to a lanyard and wherein lifting comprises raising and lowering the locking member by a crane.

10. The method of claim 1 further comprising attaching a hose to the socket member.

11. The method of claim 10 further comprising connecting the hose to a source of wellbore treatment fluid and performing a well services operation.

12. The method of claim 10 further comprising paying out a predetermined length of the hose prior to lifting.

13. An attachment system for lifting a hose to and from a predetermined location, comprising:

a support member disposed on a base and defining an indentation formed therein;

a socket member adapted to attach to the hose and to releasably rest in the indentation, the socket member defining a cavity formed therein, the socket member rotatable with respect to the support member;

a locking member attached to a lanyard; and a lifting device for raising and lower the locking member and lanyard with respect to the support member, wherein when the lifting device lowers the locking member into the socket member, and the socket member is rotated to lock the locking member in the socket member, the lifting device is operable to lift the locked socket member and locking member from and return the locked socket member and locking member to the support member.

14. The system of claim 13 wherein the socket member is remotely rotated.

15. The system of claim 13 wherein the locking member further comprises an internal locking device to lock the locking member in the socket member.

16. The system of claim 15 wherein the locking device comprises a spring loaded double rack and pinion with a central pinion gear operable to prevent the locking member from detaching from the socket member.

17. A method of lifting a hose to and from an offshore oil platform from an oceangoing stimulation vessel, comprising:

providing a remotely actuated attachment system comprising a support member, a socket member, and a locking member, the support member disposed on a surface of the vessel and defining an indentation formed therein, the socket member defining a cavity formed therein and attached to the hose, the locking member attached to a lanyard extending from a crane on the platform;

placing the socket member in the indentation and attaching the hose to the socket member;

placing the locking member in the cavity;

locking the locking member in socket member; and lifting the locking member, socket member, and hose from the support member with the crane.

18. The method of claim 17 wherein locking comprises rotating the socket member within the support member to lock the locking member in the socket member.

19. The method of claim 17 further comprising returning the locked socket member and locking member to the support member, rotating the socket member to unlock the locking member from the socket member, and removing the locking member and lanyard from the socket member.

20. The method of claim 17 further comprising connecting the hose to the platform and to a source of wellbore treatment fluid and performing a well services operation.

* * * * *